US007210328B2

(12) United States Patent
Strasser

(10) Patent No.: US 7,210,328 B2
(45) Date of Patent: May 1, 2007

(54) METAL SHEET FOLDING DEVICE WITH DEPOSITING/POSITIONING DEVICE

(75) Inventor: Johann Strasser, Kronstorf (AT)

(73) Assignee: Trumpf Maschinen Austria GmbH & Co. KG., Pasching (AT)

( * ) Notice: Subject to any disclaimer, the term of this patent is extended or adjusted under 35 U.S.C. 154(b) by 0 days.

(21) Appl. No.: 11/140,149

(22) Filed: May 27, 2005

(65) Prior Publication Data

US 2006/0179913 A1 Aug. 17, 2006

(30) Foreign Application Priority Data

Feb. 17, 2005 (AT) ..... GM 88/2005

(51) Int. Cl.
*B21J 13/10* (2006.01)

(52) U.S. Cl. ..... 72/420; 72/20.1; 72/20.3; 72/422

(58) Field of Classification Search ..... 72/20.1, 72/20.2, 20.3, 31.1, 31.11, 420, 421, 422
See application file for complete search history.

(56) References Cited

U.S. PATENT DOCUMENTS 4,784,562 A * 11/1988 Kishi et al. ..... 100/215
4,989,444 A * 2/1991 Murakami et al. ..... 72/422
5,042,287 A * 8/1991 Sartorio ..... 72/422
5,950,484 A * 9/1999 Kutschker ..... 72/420
6,722,178 B1 * 4/2004 Ito et al. ..... 72/420
6,938,454 B2 * 9/2005 Strasser et al. ..... 72/420

FOREIGN PATENT DOCUMENTS

JP 59-118233 * 7/1984
JP 2002 153929 A 5/2002

* cited by examiner

*Primary Examiner*—Ed Tolan
(74) *Attorney, Agent, or Firm*—Alston & Bird LLP

(57) ABSTRACT

A metal sheet folding device, particularly a folding press, comprising a table beam stationarily arranged on a machine frame, and a press beam arranged on the machine frame in guide arrangements with a driving device. The press beam is adjustable in relation to the table beam. Furthermore, provision is made for a sheet depositing/positioning device for at least one metal sheet plate or at least one workpiece for intermediately positioning the latter for carrying out a gripping operation with the gripping device of a handling system. The device is supported on the machine frame preferably on the table beam and adjustable in a linear guide arrangement in the direction of the longitudinal expanse of the table beam over at least part of the length.

20 Claims, 5 Drawing Sheets

METAL SHEET FOLDING DEVICE WITH DEPOSITING/POSITIONING DEVICE

BACKGROUND OF THE INVENTION

1. Field of the Invention

The invention relates to a metal sheet folding device, particularly a folding press, which is comprised of a table beam that is stationarily arranged on a machine frame; a press beam on the machine frame that is adjustable in guide arrangements in relation to the press table beam and provided with a driving device; and a depositing and positioning device for depositing at least one metal sheet plate or workpiece for intermediately positioning the latter and fully clasping it by means of the gripping equipment of a handling device.

2. Prior Art

A stationary stacking table for readying plate-like workpieces that are to be received by a handling device that is displaceable along the folding press in a linear guiding arrangement for serving a folding press, is known from patent document JP 2002 153929. In addition, provision is made for a stationary receiving device arranged within the gripping range of the handling device. The receiving device serves for intermediately depositing the workpieces, so that the gripping device can be repositioned between two folding steps carried out on a workpiece if this is required for carrying out the subsequent folding step. The device for intermediately depositing the workpiece is fitted with holding devices, so that after the workpiece has been deposited, it can be retained in a reference position for the gripping operation without any change in the position. The necessary clasping operation requires a method and adjustment of the handling device outside of the immediate vicinity of the folding press, resulting in longer periods of idling of the folding press.

SUMMARY OF THE INVENTION

The problem of the invention is to provide a metal sheet folding system with a depositing and positioning device that reduces the time span that has to be expended for fully clasping the workpiece with a gripping device between individual work steps.

The problem is resolved in that the depositing device is adjustably supported on the machine frame, preferably on the beam of the press table, and adjustable in a linear guide arrangement in the direction of the longitudinal expanse of the table beam over at least part of the length of the latter. A surprising advantage is gained in this manner in that while a folding step is still in progress, the depositing device is already adjusted independently of the handling device for the next gripping operation and set to a position that permits the workpiece to be deposited and clasped without displacing the handling device, thus saving idle time.

Beneficial in this connection is an embodiment of the metal sheet folding equipment where the depositing/positioning device is formed by support consoles that are adjustable independently of each other in relation to one another in the guide arrangement, such support consoles forming with cantilevered arms an alignment plane extending approximately perpendicular to the adjustment and work plane of the press beam. This permits changing the spacing between the support consoles directly via the adjusting servo-drives, so that such spacing can be adapted to the metal sheet plates or workpieces that are to be received and positioned.

Beneficial, however, is also an embodiment in which the support console is formed by two profiled legs arranged at right angles relative to one another. One of said profiled legs is extending perpendicularly to the set-up surface of the metal sheet folding machine, and the other profiled leg is extending perpendicularly to the adjustment and work plane, which permits obtaining a simple engineering solution for the construction of the support console.

However, an embodiment where the support device is formed by a carriage that is fitted with cantilevered arms and adjustably arranged in the guide arrangement, is advantageous as well in that the controlling and regulating expenditure is reduced in this way.

Possible are also advantageous embodiments of the metal sheet folding device where the cantilevered arms are extending perpendicularly to the adjustment and work place, and/or where at least one cantilevered arm is supported on the carriage in a linear guide and adjustable therein in relation to the other cantilevered arm, and/or where the cantilevered arm is adjustable by means of an adjusting servo-cylinder or spindle drive, because the support device can be quickly adapted to changed requirements in this way.

A low weight is gained and the force due to mass and the required driving output are consequently reduced owing to the fact that the carriage is formed by a sheet metal component.

Owing to the fact that the support consoles are adjustable in relation to each other or synchronously with each other via adjusting servo-drives, for example electric motors that are controllable independently of each other, and/or the servo-drive is arranged on the carriage, and/or the servo-drive is in driving connection with a toothed rack arranged on the machine frame or the press table beam and extending parallel to guide rails, e.g. flat track guides, round bar guides etc., and/or the servo-drive is formed by a spindle drive, very rapid adjustment movements and thus short adjustment periods are achieved.

However, an embodiment of the metal sheet folding device in which the adjusting servo-drive is formed by a servo-cylinder to which a pressure medium is admitted, is advantageous as well in that it permits achieving a simplified solution that is consequently favorable in terms of cost.

A quite universally adjustable depositing/positioning device is obtained with other advantageous embodiments as well, so that extensive refitting work can be dispensed with in many cases when changing to different workpieces.

Finally, an embodiment of the metal sheet folding device is advantageous where each support console or the carriage are connected to a controller of the sheet metal folding device via a strand of supply cable lines, e.g. a strand of trailing cables, for supplying, e.g. control signals and/or energy and/or a supply system, for example for a pressure medium, because the depositing/positioning device is integrated in this way in the overall control system of the metal sheet folding equipment.

BRIEF DESCRIPTION OF THE DRAWINGS

For the sake of better understanding, the invention is explained in greater detail with the help of the exemplified embodiments shown in the figures, in which.

DETAILED DESCRIPTION OF PREFERRED EMBODIMENTS

It is noted herewith by way of introduction that identical components are provided in the different embodiments with identical reference numbers and identical component designations, whereby the disclosures contained throughout the specification can be applied in the same sense to identical components with identical reference numbers and identical component designations. Furthermore, the positional data selected in the specification such as, for example "top", "bottom", "lateral" etc., relate to the directly described and shown figure, and are applicable in the same sense where a position has changed. Moreover, individual features or combinations of features of the different exemplified embodiments shown and described herein may represent independent inventive solutions, or solutions as defined by the invention.

Figure 1:
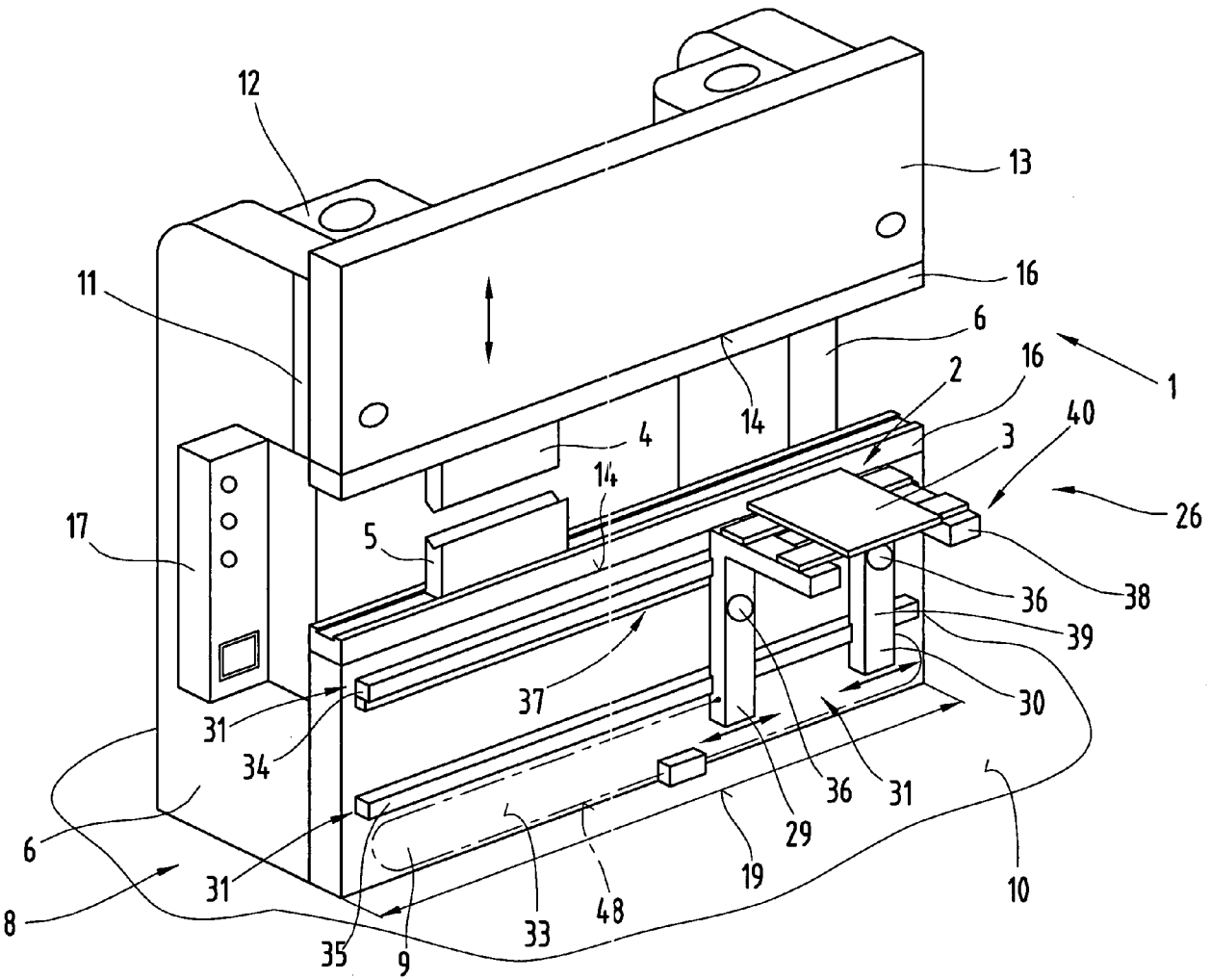
FIG. 1 is a simplified schematic representation of the metal sheet folding device as defined by the invention.
Figure 2:
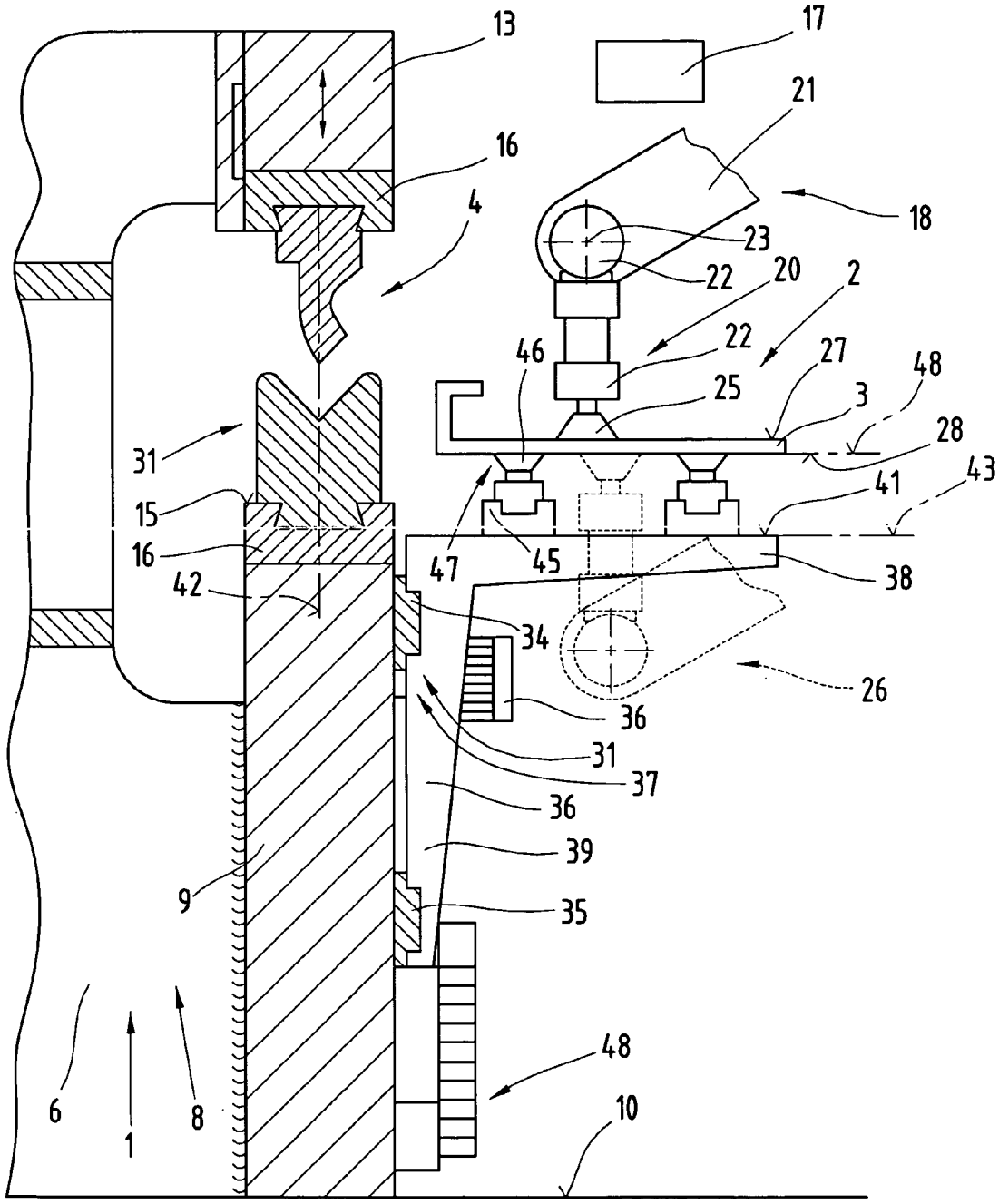
FIG. 2 is a detailed view of the metal sheet folding device as defined by the invention, with sections according to lines II—II in FIG. 3.
Figure 3:
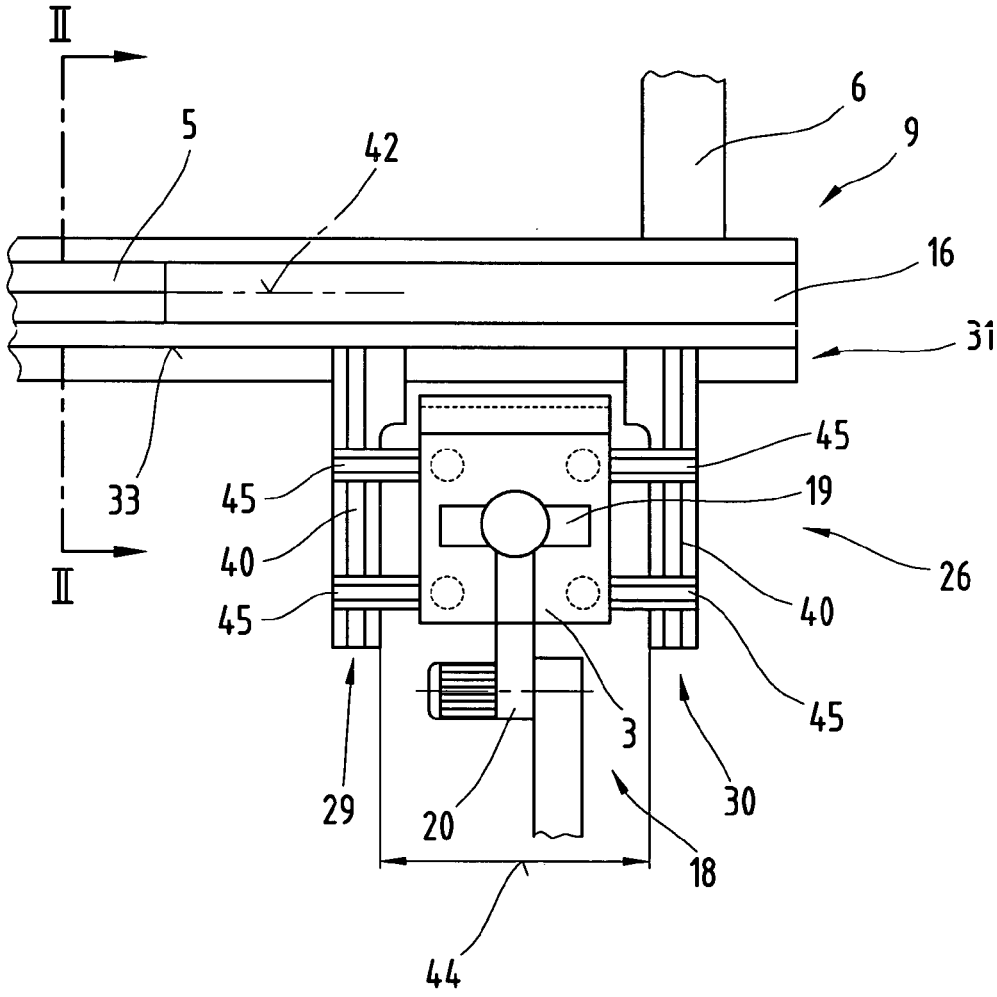
FIG. 3 is a top view of a detail of the metal sheet folding device.

FIGS. 1 to 3 show a metal sheet folding device 1, particularly a folding press for reshaping the metal sheets 2 into the workpieces 3 between the folding dies 4 and 5, which are adjustable relative to each other. The machine frame 8, which is substantially formed by the C-shaped lateral stands 6 that are aligned parallel to each other and spaced apart, and the corresponding connecting sections 7, has a table beam 9 secured on the lateral stands 6 that is anchored in a fixed manner on the faces of legs of the lateral stands 6, for example screwed or welded, etc., to said faces. The lateral stands 6 with the table beam 9 are directly supported on the set-up surface 10, or supported thereon via set-up elements. A press beam 13 that is adjustable via the drives 12, e.g. hydraulic cylinders or spindle drives, is supported opposite the table beam 9 in the guide arrangements 11 on the additional legs of the C-shaped lateral stands 6. The die chucks 16 for chucking the folding dies 4, 5 are arranged on faces of the press beam 14 and the table beam 9 opposing each other. The folding dies 4, 5 are adapted to conform to the folding operation to be carried out, whereby the standard equipment for such folding operations comprises a lower folding die with a V-shaped recess, and an upper die with a profiling approximately matching the V-shaped profiling of the lower die. Such dies are exchangeably secured in the die chucks 16 of the table beam 9 and the adjustable press beam 14. The folding dies are usually assembled from several individual dies, so that the length of the die can be selected as required for the intended folding length.

The metal sheet plate 2 is reshaped to a preset folding angle by linearly folding it between the folding dies. The engagement between said dies is adjustable, whereby the depth of immersion required for obtaining the preset folding angle is set by controlling the drives 12 via the controller 17 of the folding press 1.

It is noted that the folding device 1 comprises a number of measuring, controlling and regulating systems, as well as sensors and safety devices of the type known in the prior art, which need not be addressed here in greater detail.

Such metal sheet folding devices 1 are fed in many cases with a handling system 18, particularly a multi-axis robot especially when workpieces 3 are produced in series. The metal sheet plate 2 or workpiece 3 is usually retained by the handling device 18 during one or several successive folding operations, and the required sequence of movements is jointly performed by the handling device 18 as well.

Such a handling device 18 is preferably displaceably arranged parallel to the table beam 9 and displaced on the set-up surface 10, for example in guides over at least a length 19 of the table beam 9. In this way, several work positions and sets of dies can be arranged distributed over the length 19 of the table beam 9 or press beam 13, so that the metal sheet folding device 1 can be fitted for a number of different reshaping operations, which permits achieving high economy in the production of the workpieces 3.

For carrying out a folding operation on the metal sheet plate 2 or workpiece 3 that has already been partly reshaped previously, the latter is picked up by means of a gripping device 20, which is hinged on an arm 21 of the handling device 18, whereby preferably two rotating devices 22 are interconnected, forming the two axles of rotation 23, 24 extending vertically relative to each other. The metal sheet plate or workpiece is then positioned between the folding dies 4, 5, and the folding step is carried out by adjusting the press beam 13.

In a feasible embodiment, provision is made on the gripping device 20 for an optical detection system for acquiring the position of the workpiece for identifying it, and in order to exactly position the gripping device 20 on the metal sheet plate 2 or workpiece 3 when the latter is picked up for the first time from a stack, or also after it has been intermediately deposited, for example if it has to be fully clasped.

As shown in the exemplified embodiment, the gripping device 20 is fitted with the suction cups 25; however, it is possible to employ finger-like grippers, magnetic gripper etc. as well.

As mentioned above, the metal sheet plate 2 or workpiece 3 is retained by the gripping device 20 while it is being reshaped by folding. The arm 21 of the handling device 18 is jointly performing the required adjustment movement. The sequence of movements is realized by controlling drives of the handling device 18 via the controller 17 of the folding device 1 as well, using a network of the control system.

The gripping position of the gripping device 20 on the metal sheet plate 2 or workpiece 3 often has to be changed between two successive folding operations carried out on the metal sheet plate 2 or workpiece 3 that has already been partly shaped previously.

A depositing/positioning device 26 serves for carrying out a seizing step in which the metal sheet plate 2 or workpiece 3 is fully clasped. For this purpose, the latter is deposited on said device 26 in a defined position, retained in the position in which it is deposited, and picked up again after the gripping position has been changed by adjusting the gripping device 20. As shown by way of example by the broken lines, it may be necessary to seize the metal sheet plate 2 or workpiece 3 on the surfaces 27, 28 opposing one another. However, it may be naturally necessary also to newly position or reposition the gripping device in its gripping position on the same surface 27, 28 for subsequent folding steps in order to permit the metal sheet plate 2 or workpiece 3 to be inserted between the folding dies 4, 5 for carrying out another folding operation.

Now, the figures show that in a feasible embodiment of the depositing/positioning device 26, provision is made for the two support consoles 29, 30 arranged on the table beam 9 of the folding device 1. Said support consoles are adjustably supported in the linear guide arrangements 31, which are extending, for example in the direction of the length 19 of the table beam 9, and arranged on a surface 33. The support consoles 29, 30 are displaceable independently of one another by means of the servo-drives 36, e.g. electric motors and a toothed-rack drive 37. The servo-drives 36 are actuated and controlled in accordance with a program sequence by the controller 17 of the folding device 1.

As shown in the exemplified embodiment, the support consoles 29, 30 are each formed by the two profiled legs 31, 32 arranged at right angles in relation to one another, whereof the profiled leg 39 is aligned parallel to the surface 33, and displaceably supported in the guide arrangement 31 formed by the guide rails 34, 35. The other profiled leg 38 is forming a cantilevered arm 40, whereby the top sides 41 of the cantilevered arms 40, said top sides being aligned with each other, are forming the alignment plane 43 extending perpendicularly to the adjustment and work plane 42. On the top sides 41 of the cantilevered arms 40 of the support consoles 29, 30, said arms extending parallel to each other with an adjustable spacing 44 from one another, the cantilevered arms 45 pointing at each other are detachably secured as required, and can be positioned in the direction of a length of the cantilevered arms 40. In end areas pointing at each other, the cantilevered arms 45 are provided with at least one support means 46, which is designed to serve also as a holding means 47, and is formed, for example by a suction cup to which vacuum is admitted, or by an electromagnet etc. A support plane 48 formed by the holding means 46 is preferably extending parallel to the alignment plane 43 and perpendicularly to the adjustment and work plane 42.

As shown in FIG. 2, such a design assures that the surface 27 and 28 of the gripping device 20 opposing one another can now freely access the metal sheet plate 2 or workpiece 3 received by the holding device 26.

Owing to the fact that the support consoles 29 and 30 can be adjusted independently of one another, the spacing 44 can be adapted to the given outside dimensions of the metal sheet plate 2 or workpiece 3 to be received.

However, the fact that the support consoles 29 and 30 can be synchronously adjusted is important as well in that this permits driving the entire depositing/positioning/holding device 26 along the table beam 9 into a position in which a metal sheet plate 2 or workpiece 3 can be deposited and fully gripped by said device with a minimum of idle time. This can take place without influencing a folding operation that is in progress at the time an adjustment is made, and travel time for the handling device is significantly reduced.

As shown in FIG. 2, the support consoles 29 and 30, which are independent of each other, are each supplied by means of their own supply cable harnesses 48, e.g. so-called trailing cable caterpillars for transmitting control signals, energy, pressure medium etc.

Figure 4:
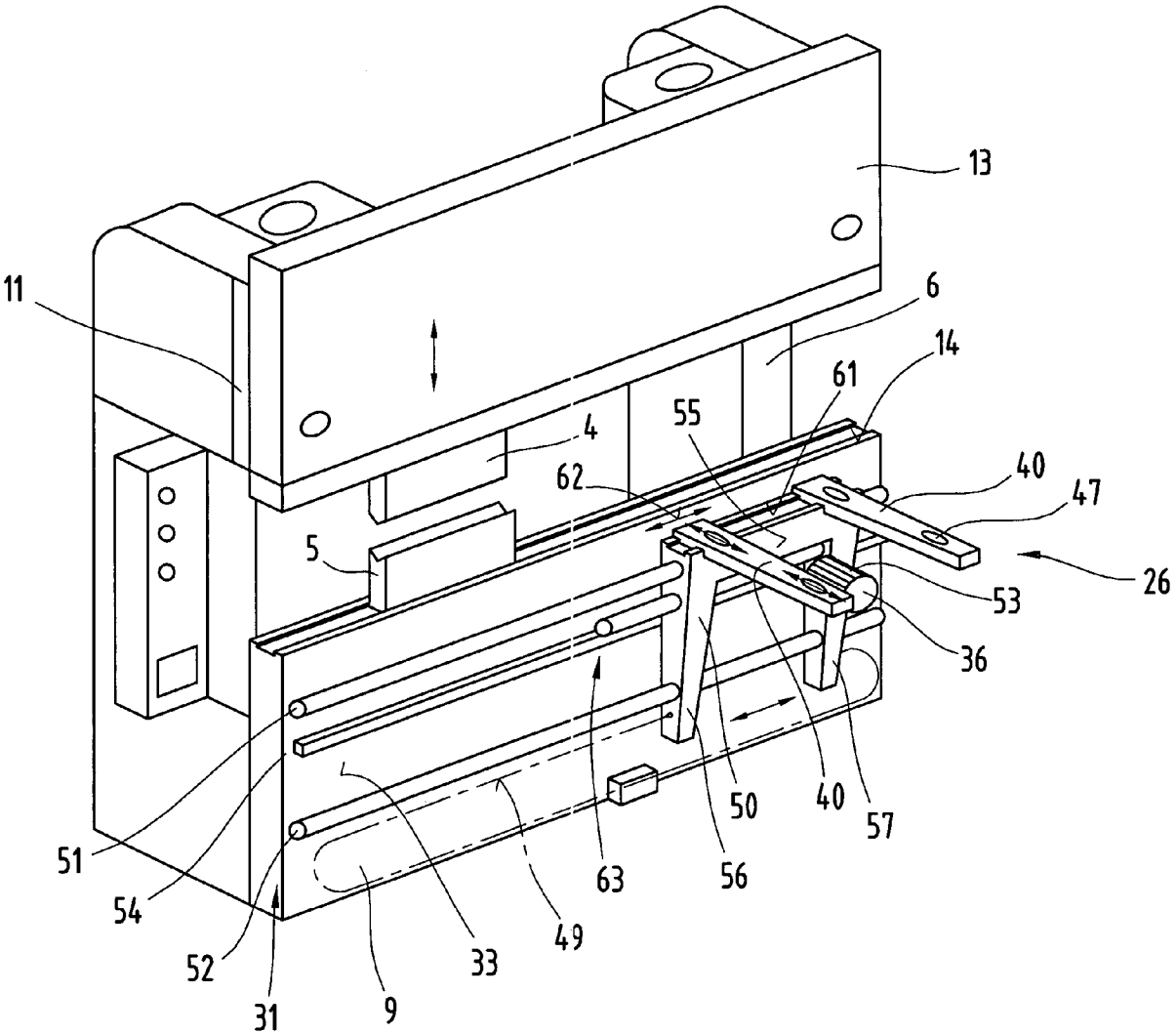
FIG. 4 is a simplified schematic representation of another embodiment of the metal sheet folding device as defined by the invention.
Figure 5:
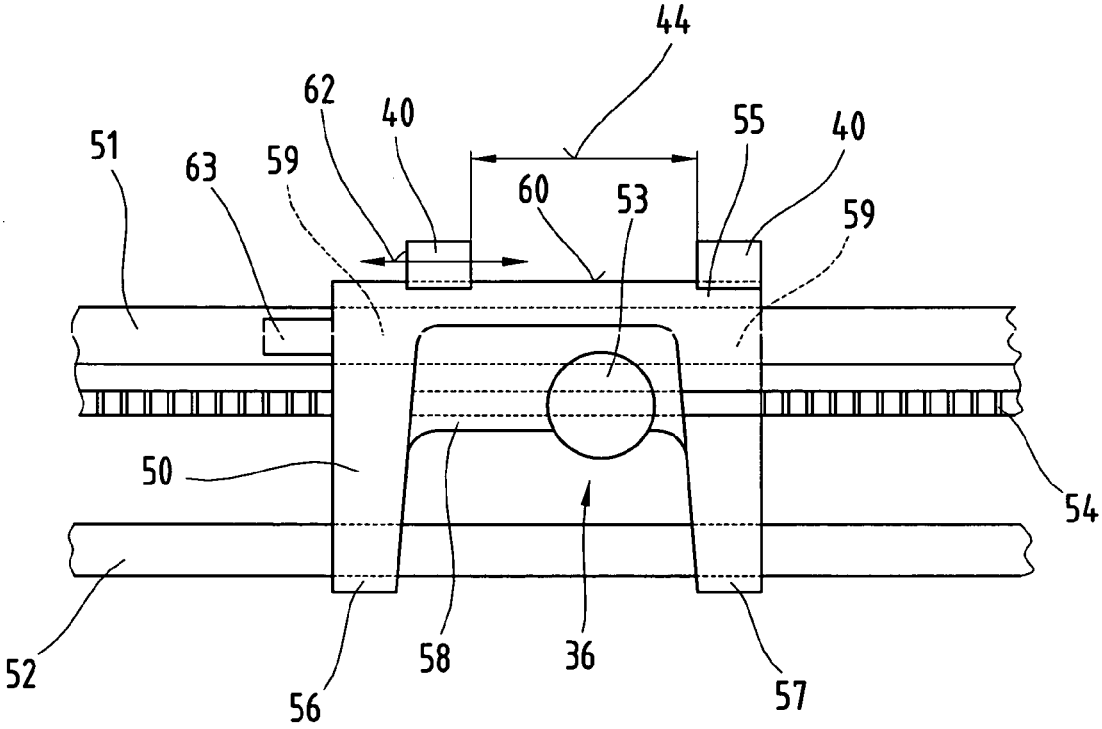
FIG. 5 is a detailed view of the other embodiment of the metal sheet folding device.

Now, FIGS. 4 and 5 show another embodiment of the metal sheet folding device 1 with the sheet-depositing/positioning device 26.

According to said embodiment, a carriage 50 equipped with the servo-drive 36 is arranged in the guide arrangements 31 on the table beam 9 and displaceable in the longitudinal direction of the table beam 9. In the exemplified embodiment shown, the guide arrangement is comprised of the round bar guides 51 and 52, which are secured on the table beam 9. The carriage 50 is supported on said bar guides, for example via rollers or rotating ball bushings. The servo-drive 36 is, for example an electric motor 53, which, via a pinion, is in driving connection with a rack secured on the table beam 9.

The carriage 50 is preferably made of a lightweight construction, e.g. in the form of a U-shaped sheet metal component with a base leg 55 and the lateral legs 56 and 57 extending approximately at right angles to the base leg. The electric motor 53 of the servo-drive 36 is secured, for example on one of the lateral legs 56 and 57, or between said legs on a connecting strut 58. The guide elements 59 cooperating with the round bar guides 51 and 52 are arranged in the base leg 55 and/or the lateral legs 56 and 57. One of the two cantilevered arms 40 is secured on the top side 60 of the base leg 55, said top side extending parallel to the face 14 of the table beam, and cantilevered in the vertical direction in relation to the surface 33. The other cantilevered arm 40 extending parallel thereto is adjustable in the linear guide 61 of the base leg 55 in relation to the stationary cantilevered arm 40, as indicated by the double arrow 62, so that the spacing 44 between the cantilevered arms 40 can be adjusted as required in accordance with the given outside dimensions of the metal sheet plate 2 or workpiece 3 to be deposited on the support device 26, for carrying out the gripping operation.

The cantilevered arm 40 is adjusted, for example via an electric motor-driven spindle drive 63 provided on the carriage 50, or via a pressure-operated cylinder.

The cantilevered arms 40 are fitted with the holding means 47, e.g. suction cups, which are adjustable in the direction of the length of the cantilevered arms 40. As already described above, however, it is possible also to make provision on the cantilevered arms 40 for the support arms 45, which in turn can be provided with the holding means 47. According to another embodiment, it is possible to make provision that the support arms 45 can be adjusted lengthwise, or to employ servo-cylinders, servo-spindles etc. as supports for the holding means 47.

Furthermore, it is noted that positioning/stop elements can be provided on the cantilevered arms 40 and/or support arms 45, on which the metal sheet plate 2 or workpiece 3 can be positioned.

However, according to a preferred embodiment, provision is made that the gripping device 20 is operated with an optical position detection system, in which case no mechanical positioning aids are required.

As already described above as well, provision can be made for the supply cable strand 48, e.g. the trailing chain cable harness 49 for controlling and supplying the drives and sensors with energy; control signals; pressure medium etc.

The exemplified embodiments show possible design variations of the metal sheet folding equipment, whereby it is noted here that the invention, however, is not limited to the design variations specifically shown herein, but that also various combinations of the individual design variations among one another are feasible, and that due to the instruction for technical execution of the present invention, such variation possibility falls within the scope of the skills of the expert engaged in the present technical field.

Therefore, any and all conceivable design variations feasible by combining individual details of the design variation shown and specified herein, are jointly covered by the scope of protection as well.

For the sake of good order, it is finally pointed out that in the interest of superior understanding of the structure of the metal sheet folding equipment, the latter and its components are to some extent shown untrue to scale and/or enlarged and/or reduced.

Most of all, the individual embodiments shown in FIGS. 1, 2, 3; 4, 5 may form the object of independent inventive solutions. Their problems and solutions as defined by the invention are disclosed by the detailed descriptions of said figures.

What is claimed is:

1. A metal sheet folding device, comprising a table beam stationarily arranged an a machine frame; a press beam arranged on the machine frame in guide arrangements with a driving device, and movable in an adjustment and work plane relative to the table beam; and a sheet-depositing/positioning device for receiving and supporting at least one sheet metal plate or workpiece for intermediately positioning the workpiece for carrying out on the workpiece a clasping operation by means of the gripping means of a handling device, wherein the sheet-depositing/positioning device is adjustably supported on the machine frame arid is displaceable in a linear guide arrangement in a longitudinal direction along a longitudinal expanse of the table beam over at least part of the length, wherein the sheet-depositing/positioning device is formed by two support consoles that are movable in the guide arrangement in the longitudinal direction both synchronously with each other for adjusting a longitudinal position of the sheet-depositing/positioning device and independently of each other for adjusting a longitudinal width of the sheet-depositing/positioning device.

2. The metal sheet folding device according to claim 1, said support consoles forming with cantilevered arms an alignment plane extending approximately perpendicularly to the adjustment and work plane.

3. The metal sheet folding device according to claim 2, wherein each support console is formed by two profiled legs arranged at right angles in relation to each other, one profiled leg extending perpendicularly to a set-up surface of the metal sheet folding device, and the other profiled leg extending perpendicularly to the adjustment and work plane.

4. The metal sheet folding device according to claim 1, wherein the support consoles are formed by a carriage fitted with cantilevered arms and adjustably supported in the guide arrangement.

5. The metal sheet folding device according to claim 4, wherein the cantilevered arms extend perpendicularly to the adjustment and work plane.

6. The metal sheet folding device according to claim 4 wherein at least one cantilevered arm is adjustably supported on the carriage in a linear guide and adjustable in relation to the ocher cantilevered arm.

7. The metal sheet folding device according to claim 6, wherein the cantilevered arm is adjustable by means of servo-drive.

8. The metal sheet folding device according to claim 6, wherein the carriage is formed by a sheet metal construction component.

9. The metal sheet folding device according to claim 1, wherein the support consoles are adjustable in relation to each other or synchronously with one another via servo-drives individually controllable independently of each other.

10. The metal sheet folding device according to claim 7, wherein the servo-drive is arranged on the carriage.

11. The metal sheet folding device according to claim 10, wherein the servo-drive is in driving connection with a toothed rack extending parallel to guide rails, said rack being arranged on the machine frame or the table beam.

12. The metal sheet folding device according to claim 11, wherein the servo-drive is formed by an electric motor-driven spindle drive.

13. The metal sheet folding device according to according to claim 11, wherein the servo-drive is formed by a servo-cylinder to which a pressure medium is admitted.

14. The metal sheet folding device according to claim 2, wherein on the cantilevered arm, at least one support arm with at least one holding means provided on said support arm is arranged and adjustable in the vertical direction in relation to the adjustment and work plane.

15. The metal sheet folding device according to claim 14, wherein the holding means is adjustably arranged on the cantilevered arm.

16. The metal sheet folding device according to claim 14, wherein the holding means is formed by a suction cup acted upon by vacuum, or by an electromagnet or by clumping tongs.

17. The metal sheet folding device according to claim 2, wherein a stop element is adjustably arranged on each cantilevered arm.

18. The metal sheet folding device according to claim 2, wherein each cantilevered arm is adjustable lengthwise.

19. The metal sheet folding device according to claim 14, wherein the support arm is formed by a pressure-operated servo-cylinder, or by a servo-spindle adjustable by an electric motor.

20. The metal sheet folding device according to claim 2, wherein each support console is connected with a controller of the metal sheet folding device via a strand of supply cables for supplying control signals and/or energy and/or supply.

* * * * *

UNITED STATES PATENT AND TRADEMARK OFFICE

CERTIFICATE OF CORRECTION

PATENT NO. : 7,210,328 B2
APPLICATION NO. : 11/140149
DATED : May 1, 2007
INVENTOR(S) : Strasser It is certified that error appears in the above-identified patent and that said Letters Patent is hereby corrected as shown below:

Column 5,

Line 32, “surface” should read --surfaces--.

Column 7,

Line 6, “an” should read --on--;

Line 15, “arid” should read --and--;

Line 46, “ocher” should read --other--;

Line 48, after “of” insert --a--.

Column 8,

Line 31, “clumping” should read --clamping--.

Signed and Sealed this

Thirty-first Day of July, 2007

JON W. DUDAS
*Director of the United States Patent and Trademark Office*